US006789886B2

(12) United States Patent
Andrews et al.

(10) Patent No.: US 6,789,886 B2
(45) Date of Patent: Sep. 14, 2004

(54) PLEATED LASER ABLATED FILTER

(75) Inventors: John R. Andrews, Fairport, NY (US); Bradley J. Gerner, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 49 days.

(21) Appl. No.: 10/284,546

(22) Filed: Oct. 30, 2002

(65) Prior Publication Data

US 2004/0085435 A1 May 6, 2004

(51) Int. Cl.[7] ..... B41J 2/175
(52) U.S. Cl. ..... 347/93
(58) Field of Search ..... 347/85, 86, 93, 347/87, 92; 156/252; 219/121.71

(56) References Cited

U.S. PATENT DOCUMENTS

| | | | | | |
|---|---|---|---|---|---|
| 4,571,599 | A | | 2/1986 | Rezanka | 347/87 |
| RE32,572 | E | | 1/1988 | Hawkins et al. | 216/27 |
| 4,774,530 | A | | 9/1988 | Hawkins | 347/63 |
| 4,864,329 | A | | 9/1989 | Kneezel et al. | 347/93 |
| 6,084,618 | A | * | 7/2000 | Baker | 347/93 |
| 6,139,674 | A | * | 10/2000 | Markham et al. | 156/252 |
| 6,199,980 | B1 | | 3/2001 | Fisher et al. | 347/93 |
| 6,523,944 | B1 | * | 2/2003 | Roy et al. | 347/85 |
| 6,644,797 | B2 | * | 11/2003 | Haines et al. | 347/93 |
| 6,702,436 | B2 | * | 3/2004 | Haines et al. | 347/93 |

* cited by examiner

*Primary Examiner*—Hai Pham
(74) *Attorney, Agent, or Firm*—Oliff & Berridge, PLC

(57) ABSTRACT

A microfluidic filter has a pleated filter structure having a plurality of pores through the structure. The pleated filter can be either an open loop or a closed loop pleated structure. The pore structure of the pleated filter is formed by laser ablation. The pleated filter is formed over an opening to an internal reservoir located on a rectangular plate and the microfluidic filter is used to filter fluids.

10 Claims, 9 Drawing Sheets

PLEATED LASER ABLATED FILTER

BACKGROUND OF THE INVENTION

The present invention relates generally to a filter structure as typically used in microfluidic devices and, more particularly, unique structures for a filter having particular use in an ink jet printer system, i.e. increasing fluid flow through a filter by increasing the surface area of the filter.

There is a trade-off in filter design between flow resistance and filter effectiveness especially for small particle size. Microfilters traditionally have a relatively high flow resistance although they offer precise filter sizing with 100 percent particle retention for particle sizes above the pore size of the filter. In thermal ink jet systems, for example, the implication for small enough pore size is that the printing frequency might be limited by the flow through the filter. For various drop sizes and printing frequencies, simple patterns of circular pores are adequate. However, there is a general interest in going to smaller drop sizes, e.g. (requiring a finer filter) and higher frequencies in the order of 15 khz and higher.

In new areas of microfluidics, microfluidic carrying devices and their components are small, typically in the range of 500 microns down to as small as 1 micron, and possibly even smaller. Such microfluidic devices pose difficulties with regards to maintaining and increasing fluid flow through the microscopic componentry, and, especially, when the particular microscopic componentry is connected to macroscopic sources of fluid. Yet such microfluidic devices are important in a wide range of applications that include drug delivery, analytical chemistry, microchemical reactors and synthesis, genetic engineering, and printing technologies including a wide range of ink jet technologies, such as thermal ink jet printing.

A typical thermally actuated drop-on-demand ink jet printing system, for example, uses thermal energy pulses to produce vapor bubbles in an ink-filled channel that expels droplets from the channel nozzles of the printing system's print head. Such print heads have one or more ink-filled channels communicating at one end with a relatively small ink supply chamber (or reservoir) and having a nozzle at the opposite end. A thermal energy generator, usually a resistor, is located within the channels near the nozzle at a predetermined distance upstream therefrom. The resistors are individually addressed with a current pulse to momentarily vaporize the ink and form a bubble which expels an ink droplet.

Some of these thermal ink jet print heads are formed by mating two silicon substrates. One substrate contains an array of heater elements and associated electronics (and is thus referred to as a heater plate), while the second substrate is a fluid directing portion containing a plurality of nozzle-defining channels and an ink inlet for providing ink from a source to the channels. This substrate is referred to as a channel plate which is typically fabricated by orientation dependent etching methods.

The dimensions of the ink inlets to the die modules, or substrates, are much larger than the ink channels. Hence, it is desirable to provide a filtering mechanism for filtering the ink at some point along the ink flow path from the ink manifold or manifold source to the ink channel or from the ink channel to the nozzle to prevent blockage of the channels by various particles typically carried in the ink. Even though some particles of a certain size do not completely block the channels, they can adversely affect directionality of a droplet expelled from these print heads.

U.S. Pat. No. 4,864,329 to Kneezel et al. discloses a thermal ink jet printhead having a flat filter placed over the inlet thereof by a fabrication process which laminates a wafer size filter to the aligned and bonded wafers containing a plurality of print heads. The individual print heads are obtained by a sectioning operation, which cuts through the two or more bonded wafers and the filter. The filter may be a woven mesh screen or preferably a nickel electroformed screen with predetermined pore size. Electroformed screen filters having pore size which is small enough to filter out particles result in filters which are very thin and subject to breakage during handling or wash steps. Also, the preferred nickel embodiment for a filter is not compatible with certain inks resulting in filter corrosion. Finally, the choice of materials is limited when using this technique. Woven mesh screens are difficult to seal reliably against both the silicon ink inlet and the corresponding opening in the ink manifold. Further, plating with metals such as gold to protect against corrosion is costly. This patent is intended to be incorporated by reference herein in its entirety.

In all cases, conventional microfilters ordinarily suffer from blockage by particles larger than the pore size, and by air bubbles. Conventional microfilters used for thermal ink jet print heads help keep the jetting nozzles and channels free of clogs caused by dirt and air bubbles carried into the printhead from upstream sources such as from the ink supply cartridge. One common failing of all planar microfilters is their relatively high flow resistance and limited surface area for filter pores.

In laser ablated filters, circular holes are laser ablated in a flat planar plastic film, which may then be bonded over the ink inlets of many die at once in a thermal ink jet wafer, as taught in U.S. Pat. No. 6,139,674, to Markham et al. and U.S. patent application Ser. No. 6,199,980, to Fisher et al., both commonly assigned as the present application and both incorporated by reference. However, even when the holes are packed as tightly as possible, the open planar area for typical filter dimensions may be on the order of 40%.

In an ink jet system environment, one of the basic objectives of the embodiments of the present invention is to provide a filter which will prevent particles of a size sufficient to block channels from entering the printhead channels and minimize fluid flow resistance due to the filter along the ink flow path.

It is an object of the present invention to provide a microfluidic filtering device with increased surface area.

SUMMARY OF THE INVENTION

According to the present invention, a microfluidic filter has a pleated filter structure having a plurality of pores through the structure. The pleated filter can be either an open loop or a closed loop pleated structure. The pore structure of the pleated filter is formed by laser ablation.

Another embodiment of the present invention is directed to an improved ink jet printhead having an ink inlet in one of its surfaces, a plurality of nozzles, individual channels connecting the nozzles to an internal ink supplying manifold, the manifold being supplied ink through the ink inlet, and selectively addressable heating elements for expelling ink droplets, the improved ink jet printhead comprising a pleated filter having predetermined dimensions with the filter having a plurality of pores. The open loop pleated filter can be bonded within the printhead at the ink inlet or the closed loop pleated filter can be bonded at other points along the ink flow path between the manifold and the nozzle.

Other objects and attainments together with a fuller understanding of the invention will become apparent and appreciated by referring to the following description and claims taken in conjunction with the accompanying drawings.

BRIEF DESCRIPTION OF THE DRAWINGS

A more complete appreciation of the invention and many of the attendant advantages thereof will be readily obtained and understood by referring to the following detailed description and the accompanying drawings in which like reference numerals denote like elements as between the various drawings. The drawings, briefly described below, are not to scale.

DETAILED DESCRIPTION

In the following detailed description, numeric ranges are provided for various aspects of the embodiments described. These recited ranges are to be treated as examples only, and are not intended to limit the scope of the claims hereof. In addition, a number of materials are identified as suitable for various facets of the embodiments. These recited materials are to be treated as exemplary, and are not intended to limit the scope of the claims hereof. In addition, the figures are not drawn to scale for ease of understanding the present invention.

It will become evident from the following description of the various embodiments of the present invention that the various embodiments of this invention are equally well suited for use in a wide variety of microfluidic carrying devices, and is not necessarily limited in its application to an ink jet system or the particular thermal ink jet print system shown and described herein. However, a thermal ink jet printing system is being described in detail to give an example of the type of environment (i.e. the kind of microfluidic device) that can be used with the present invention.

Figure 1:
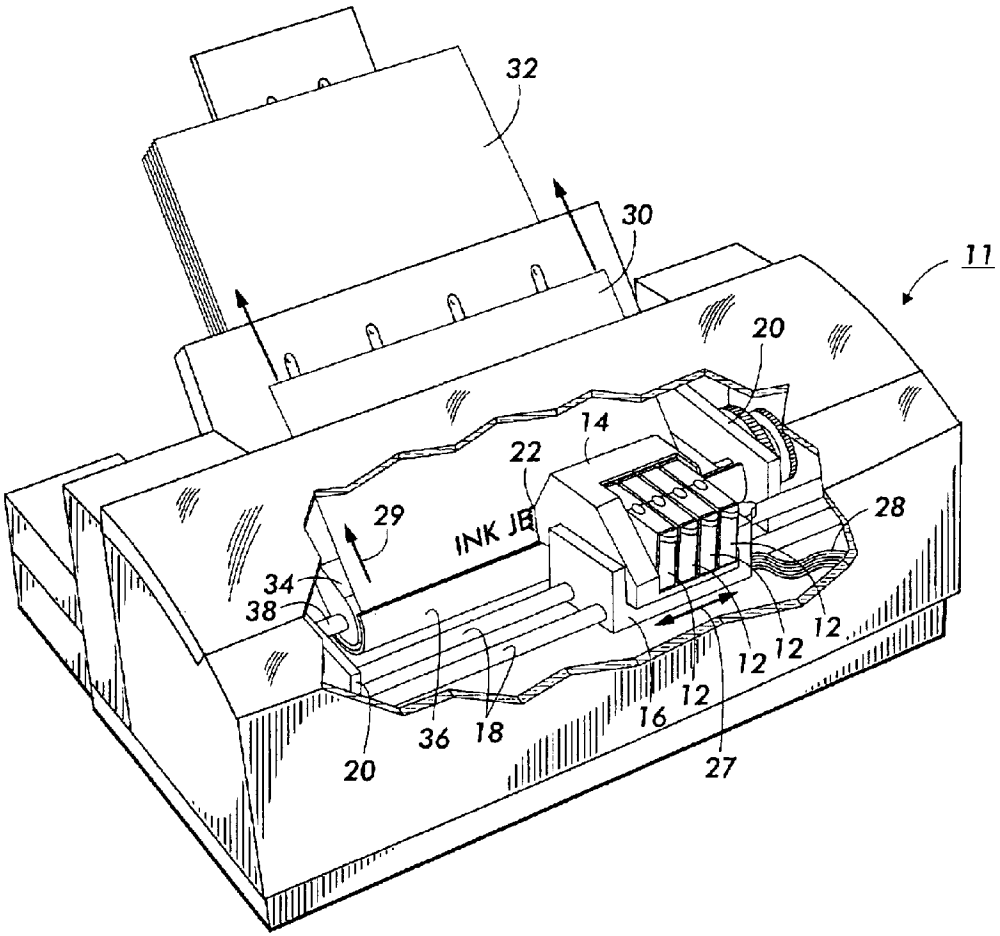
FIG. 1 is an isometric view of a color ink jet printer having replaceable ink jet supply tanks.
Figure 2:
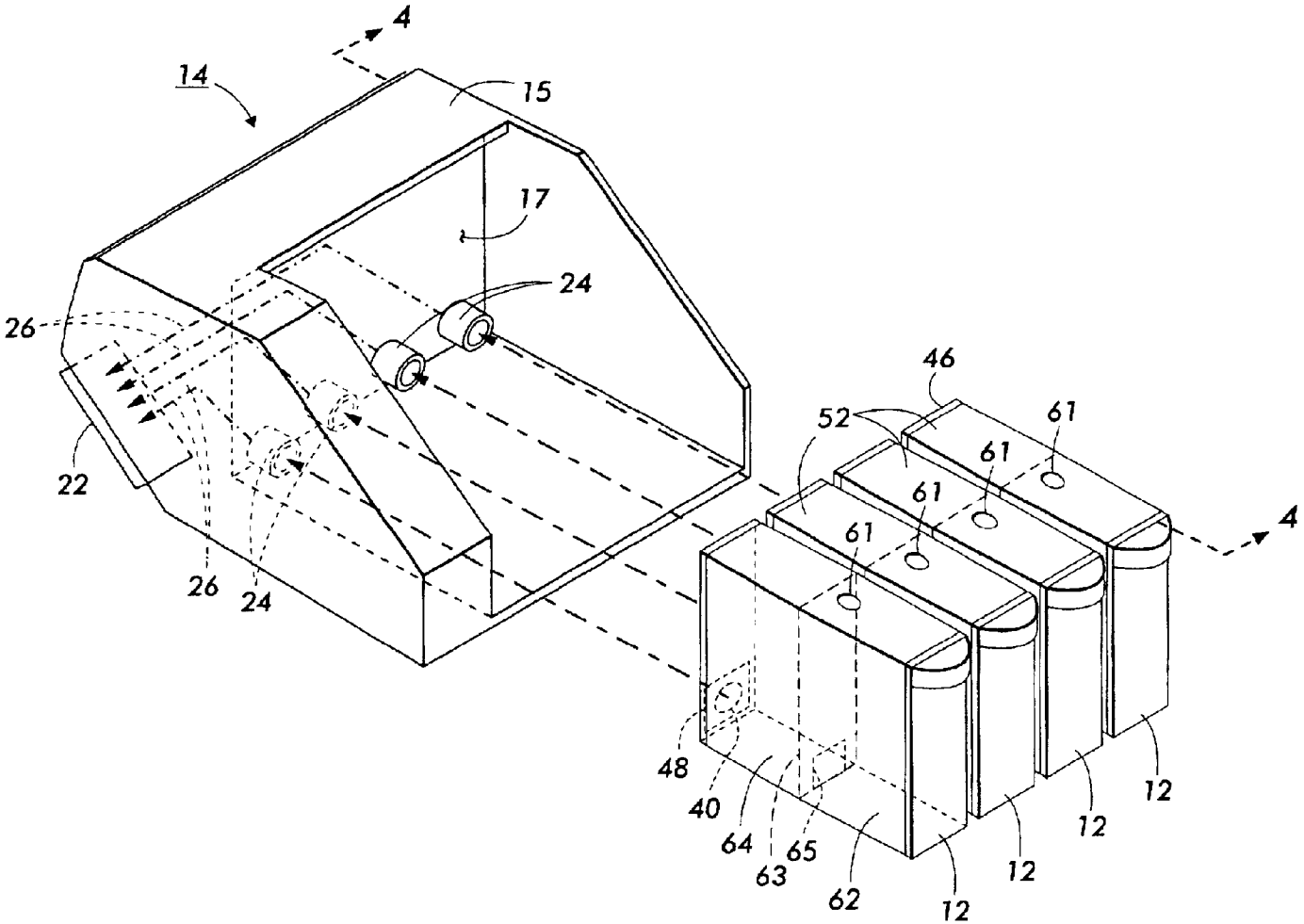
FIG. 2 is a partially exploded isometric view of an ink jet cartridge with integral printhead and ink connectors and replaceable ink tank.

FIG. 1 illustrates an isometric view of a multicolor thermal ink jet printer 11 which can incorporate any of the preferred embodiments of the present invention. The particular printer shown and described herein includes four replaceable ink supply tanks 12 mounted in a removable ink jet cartridge 14. The ink supply tanks may each have a different color of ink, and in a preferred embodiment, the tanks have yellow, magenta, cyan, and black ink. The removable cartridge is installed on a translatable carriage 16 which is supported by carriage guide rails 18 fixedly mounted in frame 20 of the printer 11. The carriage is translated back and forth along the guide rails by any suitable means (not shown) as well known in the printer industry, under the control of the printer controller (not shown). Referring also to FIG. 2, the ink jet cartridge 14 comprises a housing 15 having an integral multicolor ink jet printhead 22 and ink pipe connectors 24 which protrude from a wall 17 of the cartridge for insertion into the ink tanks when the ink tanks are installed in the cartridge housing. Ink flow paths, represented by dashed lines 26, in the cartridge housing interconnects each of the ink connectors with the separate inlets of the printhead. The ink jet cartridge, which comprises the replaceable ink supply tanks that contain ink for supplying ink to the printhead 22, includes an interfacing printed circuit board (not shown) that is connected to the printer controlled by ribbon cable 28 through which electric signals are selectively applied to the printhead to selectively eject ink droplets from the printhead nozzles (not shown). The multicolor printhead 22 contains a plurality of ink channels (not shown) which carry ink from each to the ink tanks to respective groups of ink ejecting nozzles of the printhead.

When printing, the carriage 16 reciprocates back and forth along the guide rails 18 in the direction of arrow 27. As the printhead 22 reciprocates back and forth across a recording medium 30, such as single cut sheets of paper which are fed from an input stack 32 of sheets, droplets of ink are expelled from selected ones of the printhead nozzles towards the recording medium 30. The nozzles are typically arranged in a linear array perpendicular to the reciprocating direction of arrow 27. During each pass of the carriage 16, the recording medium 30 is held in a stationary position. At the end of each pass, the recording medium is stepped in the direction of arrow 29. A more detailed explanation of the printhead and the printing thereby, is found in U.S. Pat. No. 4,571,599 and U.S. Pat. No. Re 32572, the relevant portions of which are incorporated herein by reference.

A single sheet of recording medium 30 is fed from the input stack 32 through the printer along a path defined by a curved platen 34 and a guide member 36. The sheet is driven along the path by a transport roller 38 as is understood by those skilled in the art. As the recording medium exits a slot between the platen 34 and guide member 36, the sheet 30 is caused to reverse bow such that the sheet is supported by the platen 34 at a flat portion thereof for printing by the printhead 22.

With continued reference to FIG. 2, ink from each of the ink supply tanks 12 is drawn by capillary action through the outlet port 40 in the ink supply tanks, the ink pipe connectors 24, and inflow paths 26 in the cartridge housing to the printhead 22. The ink pipe connectors and flow paths of the cartridge housing supplies ink to the printhead ink channels, replenishing the ink after each ink droplet ejection from the nozzle associated with the printhead ink channel. It is important that the ink at the nozzles be maintained at a slightly negative pressure, so that the ink is prevented from dripping onto the recording medium 30, and ensuring that ink droplets are placed on the recording medium only when a droplet is ejected by an electrical signal applied to the heating element in the ink channel for the selected nozzle. A negative pressure also ensures that the size of the ink droplets ejected from the nozzles remain substantially constant as ink is depleted from the ink supply tanks. The negative pressure is usually in the range of −0.5 to −5.0 inches of water. One known method of supplying ink at a negative pressure is to place within the ink supply tanks an open cell foam or needled felt in which ink is absorbed and suspended by capillary action.

As shown in FIG. 2, each supply tank 12 comprises a housing 52 of any suitable material, such as, for example, polypropylene which contains two compartments separated by a common wall 63. A first compartment 62 has ink stored therein which is introduced therein through inlet 61. A second compartment 64 has an ink absorbing material 42, such as, for example, an open cell foam member for needled felt member inserted therein. An example of an open cell foam is reticulated polyurethane foam. A scavenger member (not shown) is incorporated adjacent to the outlet port 40 when a needled felt of polyester fibers are used which has greater capillary than the needled felt. Ink from compartment 62 moves through aperture 65 in the common wall 63 to contact the ink absorbing material member (not shown) and saturate the ink absorbing material member with ink. The ink absorbing material member before insertion into the second compartment 64 has between three and four times the volume of compartment 64, so that the ink absorbing material member which in the preferred embodiment is a foam member, is compressed to 25% to 30% of its original size. The second compartment of the ink supply tank 12 has an open end (not shown) through which the ink absorbing material member (not shown) is inserted. Cover plate 46 has the same material as the housing 52 and has an outlet port 40, shown in dashed line. The cover plate 46 is welded into place following foam member insertion into the second compartment of the ink supply tank. Strength of the heat stake weld is important only during the fabrication process, for the filter is otherwise mechanically locked in place by the wall 17 of the cartridge 14 containing the ink pipe connectors 24, and the force from the compressed ink absorbing material member (not shown) when the ink supply tank 12 is installed in the cartridge. This yields a robust construction with an internal retention mechanism that keeps contaminants at their point of origin.

Figure 3:
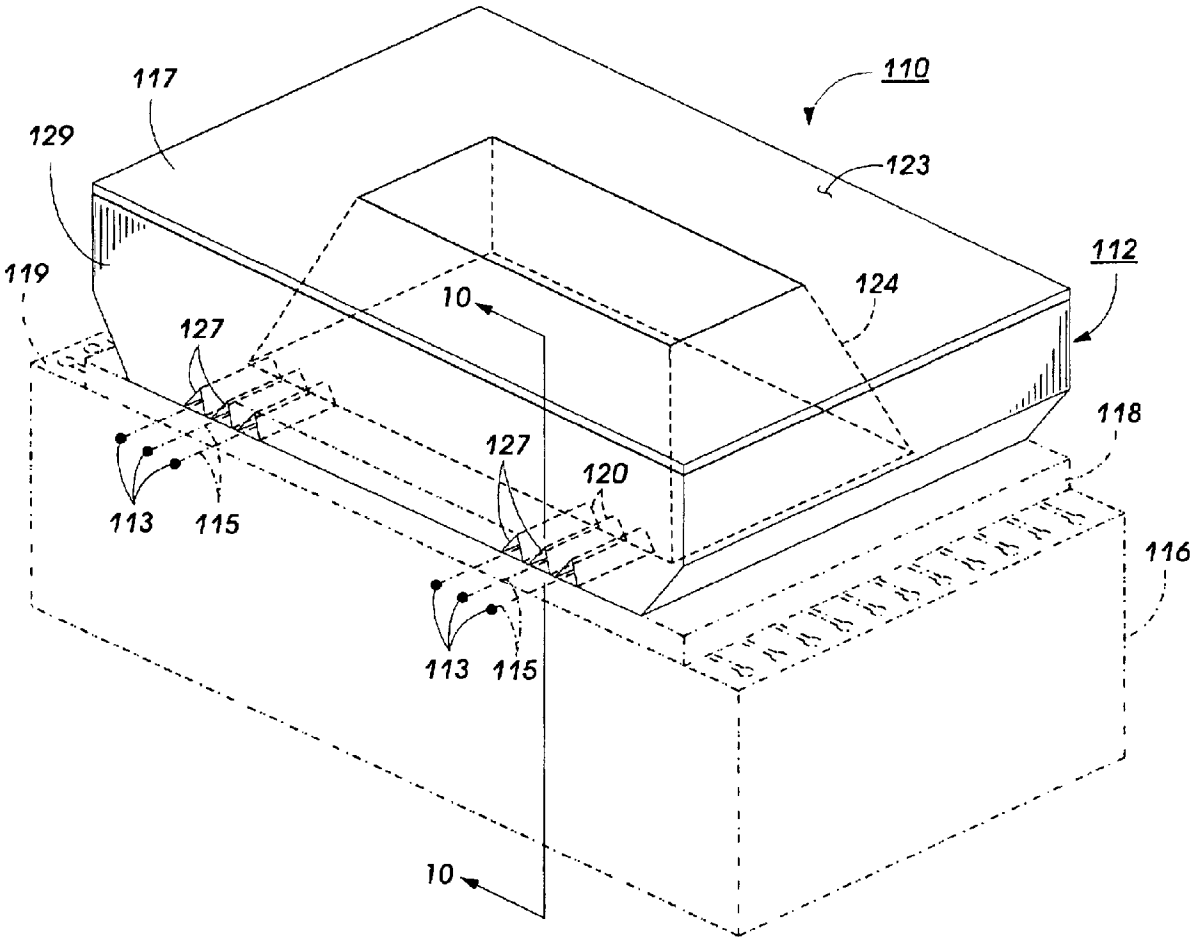
FIG. 3 is a schematic isometric view of an inkjet printhead module.
Figure 4:
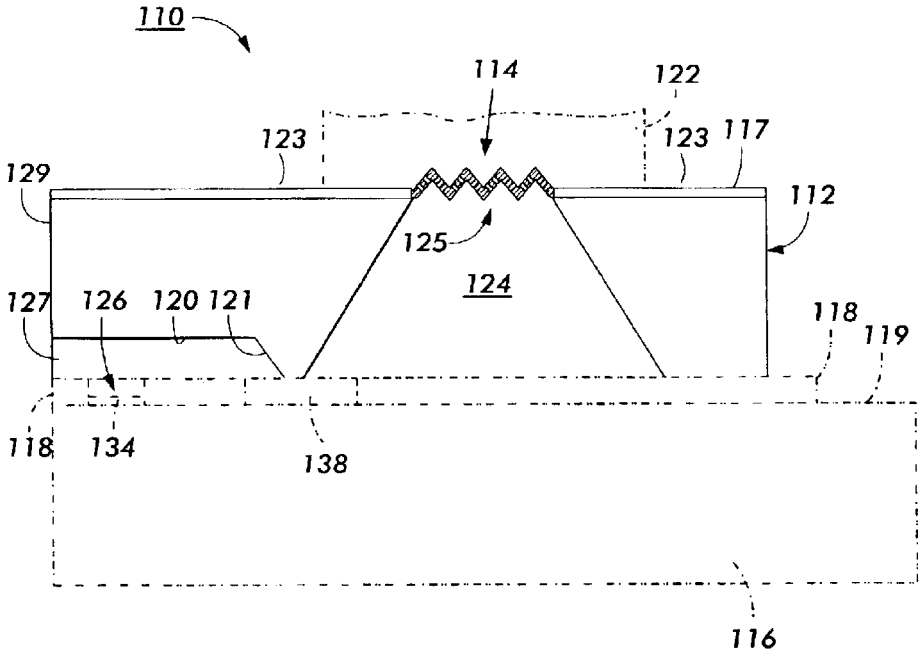
FIG. 4 is a cross-sectional view of the inkjet printhead module of FIG. 3.

Referring to FIGS. 3 and 4, there is shown a die module print head 110 similar to that described in U.S. Pat. No. 6,139,674, having an open loop pleated laser ablated filter 114 of this invention covering its ink inlets 125. This present invention describes several novel pore configurations for the laser ablated filter 114.

In FIGS. 3 and 4, a thermal ink jet printhead or die module 110 in accordance with present invention is shown comprising channel plate 112 with open loop pleated laser ablated filter of this invention 114 and heater plate 116 shown in dashed line. The pores of the filter 114 are shown schematically, but would have a structure comprising any of the defined embodiments of the present invention. As disclosed in U.S. Pat. No. 4,774,530 to Hawkins and incorporated herein by reference in its entirety, the thick film layer is etched to remove material above each heating element 134, thus placing them in pits 126. Material is removed between the closed ends 121 of ink channels 120 and the reservoir 124, forming trench 138 placing the channels 120 into fluid communication with the reservoir 124. For illustration purposes, droplets 113 are shown following trajectories 115 after ejection from the nozzles 127 in front face 129 of the printhead.

Channel plate 112 is permanently bonded to heater plate 116 or to the patterned thick film layer 118 optionally deposited over the heating elements and addressing electrodes on the top surface 119 of the heater plate and patterned as taught in the above-mentioned U.S. Pat. No. 4,774,530. The channel plate is preferably silicon and the heater plate may be any insulative or semiconductive material as disclosed in U.S. Pat. No. Reissue 32,572 to Hawkins et al. which is incorporated by reference herein. The illustrated embodiment of the present invention is described for an edge-shooter type printhead, but could readily be used for a roofshooter configured printhead (not shown) as disclosed in U.S. Pat. No. 4,864,329 to Kneezel et al., incorporated herein by reference, wherein the ink inlet is in the heater plate.

Channel plate 112 of FIG. 3 contains an etched recess 124, shown in dashed line, in one surface which, when mated to the heater plate 116, forms an ink reservoir. A plurality of identical parallel grooves 120, shown in dashed line and having triangular cross sections, are etched (using orientation dependent etching techniques) in the same surface of the channel plate with one of the ends thereof penetrating the front face 129. The other closed ends 121 (FIG. 4) of the grooves are adjacent to the recess 124. When the channel plate and heater plate are mated and diced, the groove penetrations through front face 129 produce the orifices or nozzles 127. Grooves 120 also serve as ink channels which contact the reservoir 124 (via trench 138) with the nozzles. The open bottom of the reservoir in the channel plate, shown in FIG. 4, forms an ink inlet 125 and provides means for maintaining a supply of ink in the reservoir through a manifold from an ink supply source in an ink cartridge 122, partially shown in FIG. 10. The cartridge manifold is sealed to the ink inlet by adhesive layer 123.

The filter structure, i.e., the pore structure for a filter, in accordance with the features of the present invention, is manufactured by a laser ablation system. The laser ablation process functions to effectively remove at least part of the predetermined portion of the material to form the filter pores without the need for chemical or mechanical treatments.

Figure 5:
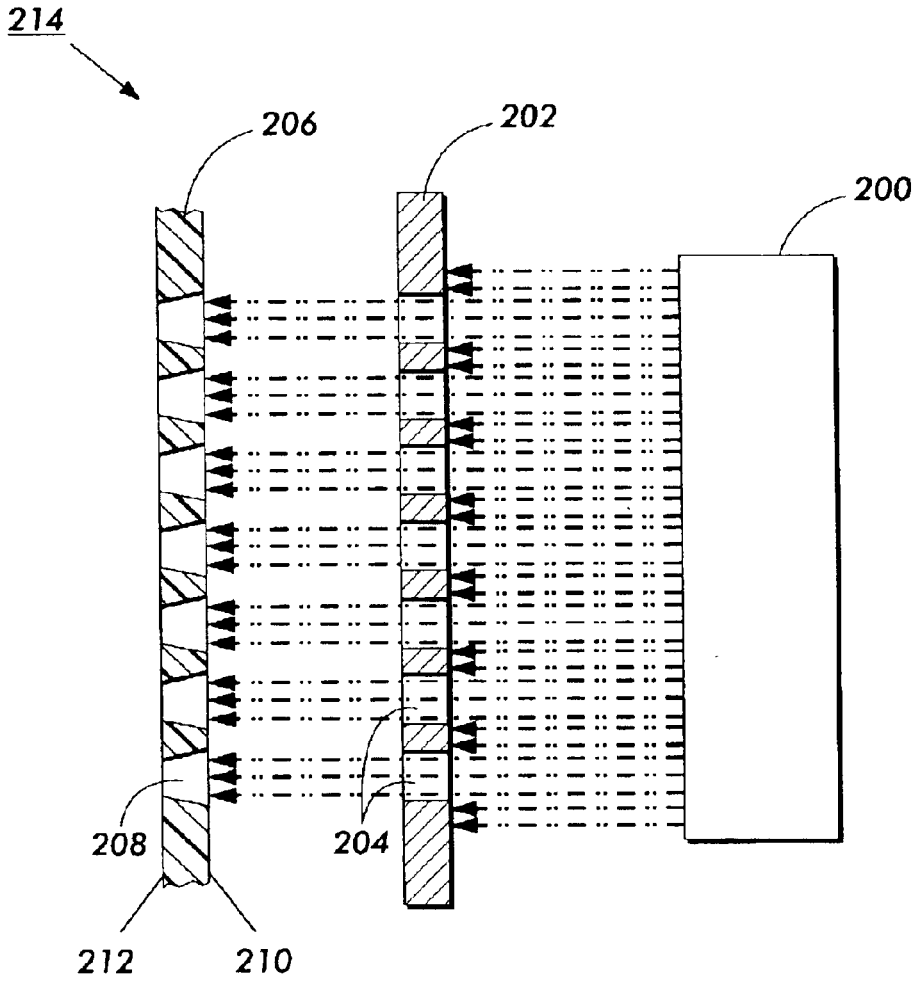
FIG. 5 shows laser ablation through a mask of a thin polymer film to form the filter of the present invention.

Referring to FIG. 5, large diameter output beams are generated by excimer laser 200 and directed to a mask 202 having a plurality of holes 204, with total area sufficient to cover the thin polymer film layer 206, which can be Upilex.

The polymer film layer may also be Kapton or any of other polymer films which are selected for chemical compatibility with the inks and the temperature and pressure of the inks. Examples of other films include polyester, polysulfone, polyetheretherketone, polyphenelyene sulfide, and polyethersulfone. Filters formed by laser ablation can be made of materials that are not commercially available in filter form.

The holes 204 can be closely packed in density with diameters as small as 2.5 microns. The radiation passing through the mask 202 forms a plurality of holes 204 in polymer film layer 206 from the top first surface 210 through to the bottom second surface 212.

Ablated film 206 has thus been fabricated into filter 214 with the holes 204 becoming the filter pores for fluid flow. The filter size must be large enough to provide an adequate seal at the inlet or outlet or location within the printhead with enough edge surface to allow an adhesive layer to be bonded to the edges.

Figure 6:
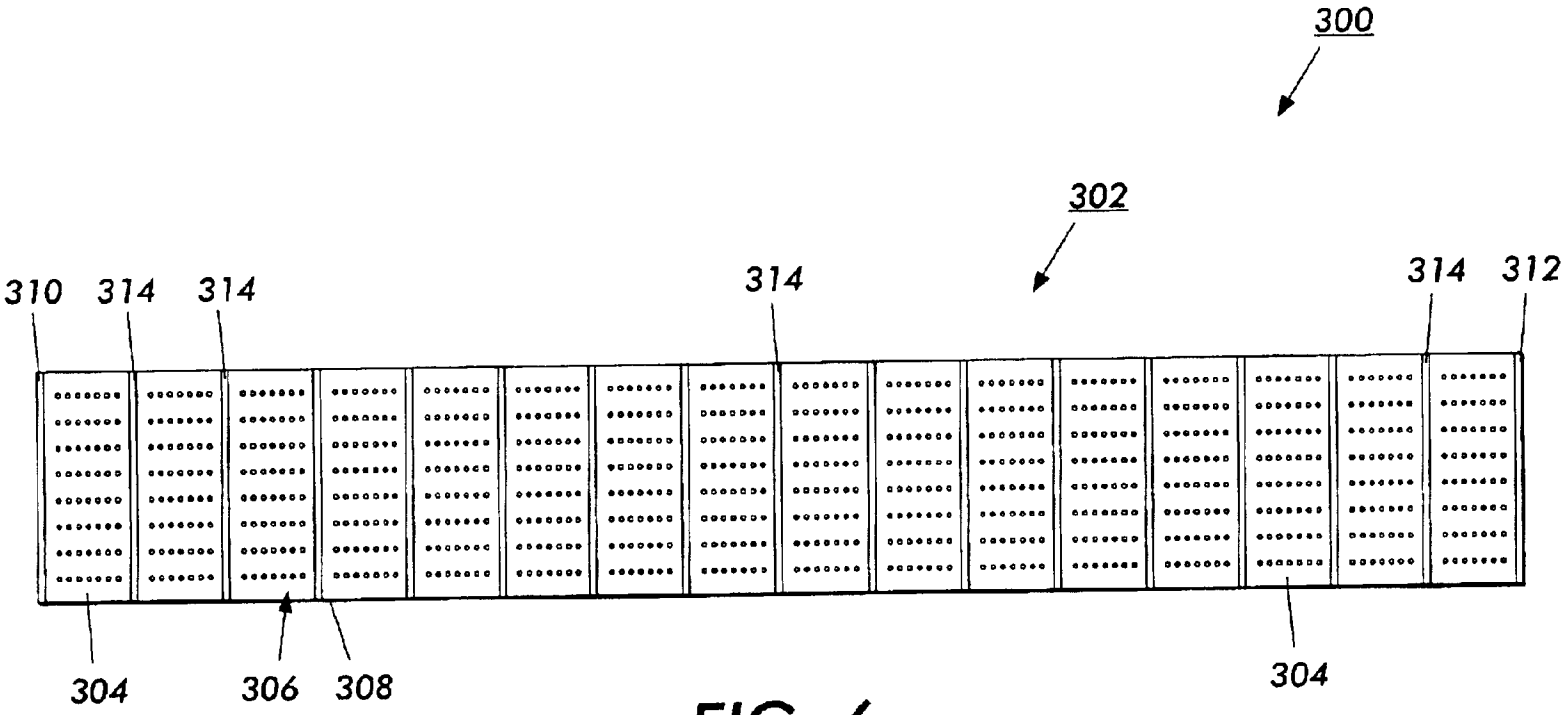
FIG. 6 is a perspective view of a planar semicircular polymer film in accordance with the features of the present invention.

For the pleated filter 300 of FIG. 6, a substantially elongated rectangular planar thin film polymer layer 302 is laser ablated to form filter pores 304 through the film layer from the top first surface 306 to the bottom second surface 308.

The rectangular planar thin film polymer layer 302 has a first end 310 and an opposing second end 312. The polymer layer 302 has transverse fold lines 314 at regular periodic intervals between the ends 310, 312 across the length of the thin polymer layer.

Figure 7:
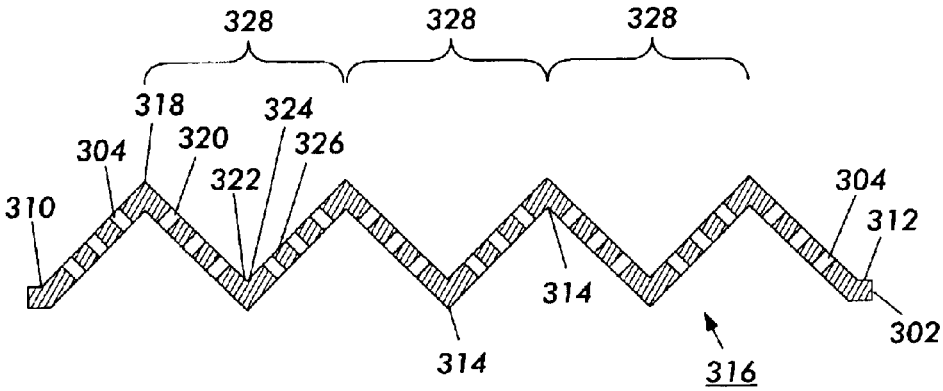
FIG. 7 is a side view of an open loop pleated filter structure in accordance with the features of the present invention.

After laser ablation to form the filter pores, the substantially elongated rectangular planar thin film polymer layer 302 as shown in FIG. 7 is folded at the fold lines 314 by crimping or other mechanical means to form a pleated filter 316.

The transverse fold lines 314 will alternate between going up to form the peak 318 of a ridge 320 and going down to form the base 322 of a groove 324.

The pleated filter 316 has repeating cycles of a first straight ridge 320, a groove 324 and a second straight ridge 326, opposite the first ridge, to form a V-shaped pleat 328. By folding the thin film polymer layer 302 at the periodic intervals of the transverse fold lines 314, the pleats 328 of the filter 316 will have the same height, the same surface area and, with a uniform pore density, the same number of filter pores.

Since the ends 310 and 312 of the pleated filter 316 are not secured to each other, nor to a ridge 320 of the pleat 328 nor to a groove 324 of the pleat 328, the pleated filter 316 is an open loop pleated filter.

The open loop pleated filter 316 will be single ply with multiple pleats 328.

The open loop pleated filter 316 can be bonded to the ink inlet 125 of the print head 110 as laser ablated filter 114 in FIG. 4. The filter 316 can be bonded at the ends 310 and 312 and the edges of the pleats 328 to the walls and recesses of the channel plate 112. The bonding adhesive can be phenolic nitrile, epoxy, acrylic or other adhesives. Alternately, the filter can be bonded between upper and lower corrugated structures (not shown) of stamped or molded thermoplastics with two-sided adhesives. Also alternately, a conformal gasket such as a fluid seal can be used to seal the filter.

Figure 8:
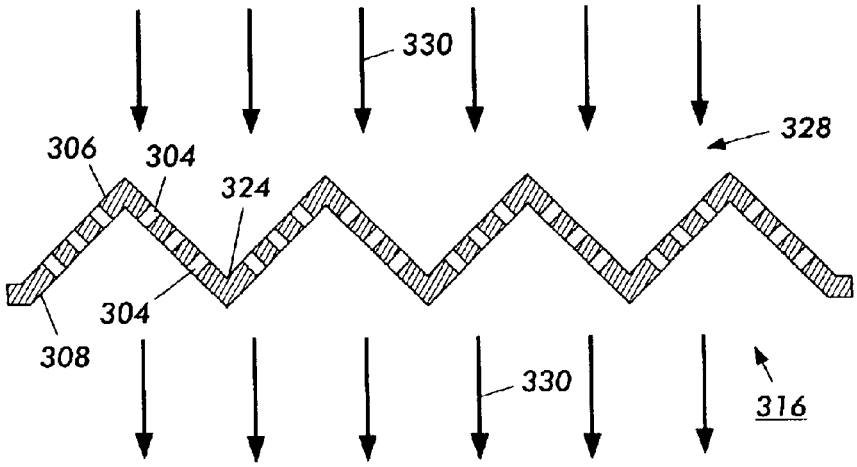
FIG. 8 is a perspective view of fluid flow into the open loop pleated filter of FIG. 7.

As shown in FIG. 8, fluid 330 will flow perpendicular to the open loop pleated filter 316. The fluid will flow through the pores 304 on the top surface 306 and out through the pores 304 on the bottom surface 308. Any particles in the fluid larger than the filter pores will be trapped outside the pleated filter in the groove 324 with clean, particle-free fluid flowing downstream from the pleated filter.

The open loop pleated filter 316 will have a straight "v-shaped" pleat 328. The pleat 328 provides the lowest resistance to fluid flow through the pleated filter and a uniform distribution of fluid across the entire surface of the pleated filter. An increased pleat density maximizes the fluid flow through the filter. However, an increased plate density must still maintain a separation between pleats to allow free fluid flow with no obstructions.

A pleated configuration to the filter increases the surface area of the filter within a given volume of space. A pleated configuration also increases the structural strength of the filter, particularly with fluid flow across the filter.

Figure 9:
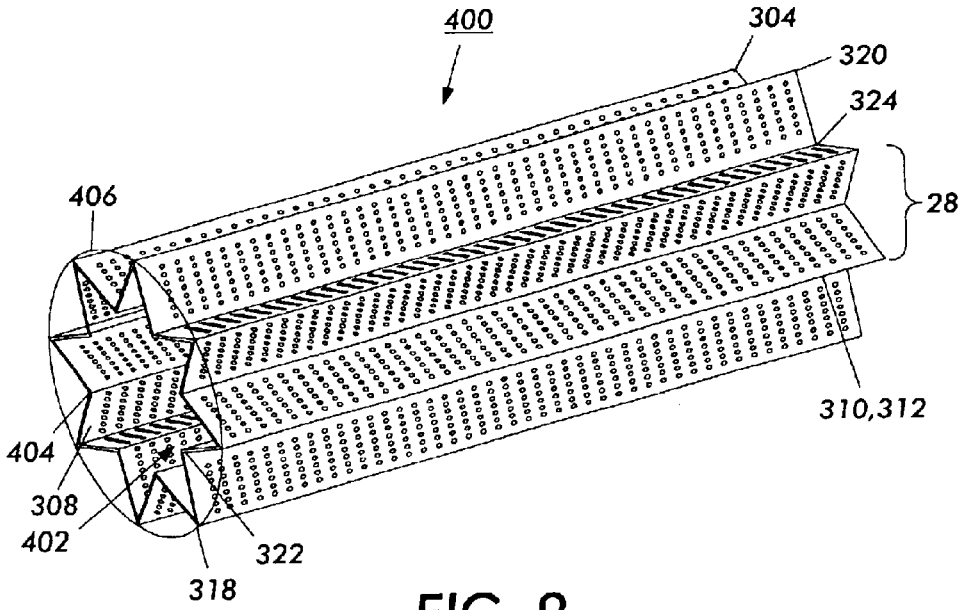
FIG. 9 is a perspective view of a closed loop pleated filter in accordance with the features of the present invention.

As shown in FIG. 9, after folding, the pleated rectangular thin film polymer layer 302 with filter pores 304 can be curved to form a cylindrical shape to form a closed loop pleated filter 400. The first end 310 and the second end 312 of the thin film layer 302 can be bonded together or to a ridge 320 of a pleat 328 or groove 324 of a pleat 328.

The closed loop pleated filter 400 will be single ply with multiple pleats 328.

The closed loop pleated filter 400 will have an interior chamber 402 within the bottom surfaces 308 of the pleats 328.

The base 322 of each groove 324 in each pleat 328 will cumulatively form the inner circumference 404 of the closed loop pleated filter 400. The peak 318 of each ridge 320 in each pleat 328 will cumulatively form the outer circumference 406 of the closed loop pleated filter 400.

Figure 10:
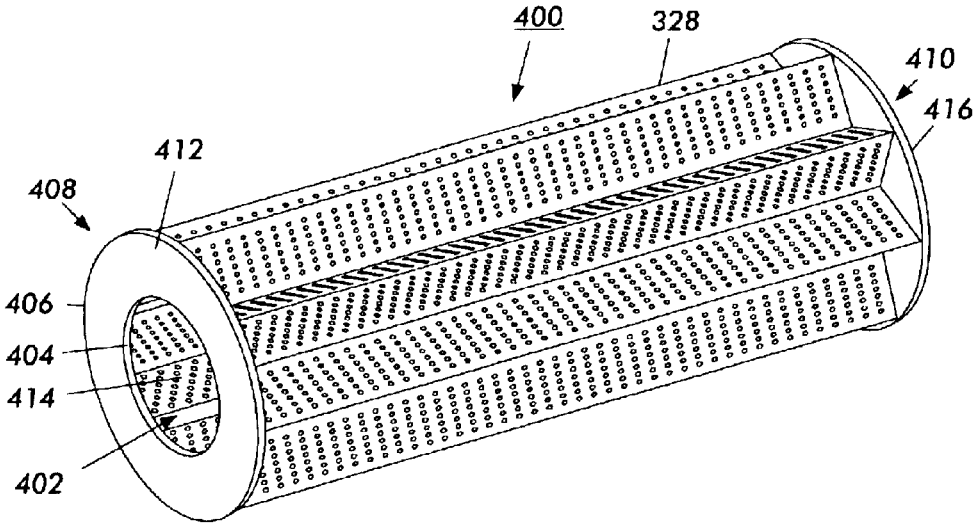
FIG. 10 is a perspective view of a closed loop pleated filter with a closed end in accordance with the features of the present invention.

As seen in FIG. 10, the closed loop pleated filter 400 will have an open end 408 and a closed end 410. The open end 408 will have an annular ring 412 with an open central bore 414 to the interior chamber 402 of the closed loop pleated filter. The annular ring 412 will extend from the outer circumference 406 of the pleats 328 to the inner circumference 404 of the pleats 328 and be bonded to the edges of the pleats 328 to prevent fluid flow from these areas.

The central bore 414 of the annular ring 412 can function as either the inlet port or outlet port for fluid flow through the closed loop pleated filter 400.

The closed end 410 of the closed loop pleated filter 400 can have a flat circle 416 bonded to the edges of the pleats 328.

The annular ring 412 and the flat circle 416 can be formed of a polymer material layer.

The ablated filter or filtering device 214 can then be placed into the fluid flow path between an ink supply cartridge 12 and the channels 124 and nozzles 127 of an ink jet printhead 110 in FIGS. 3 and 4.

Fluid can flow through the closed loop pleated filter 400 in two different paths.

Figure 11:
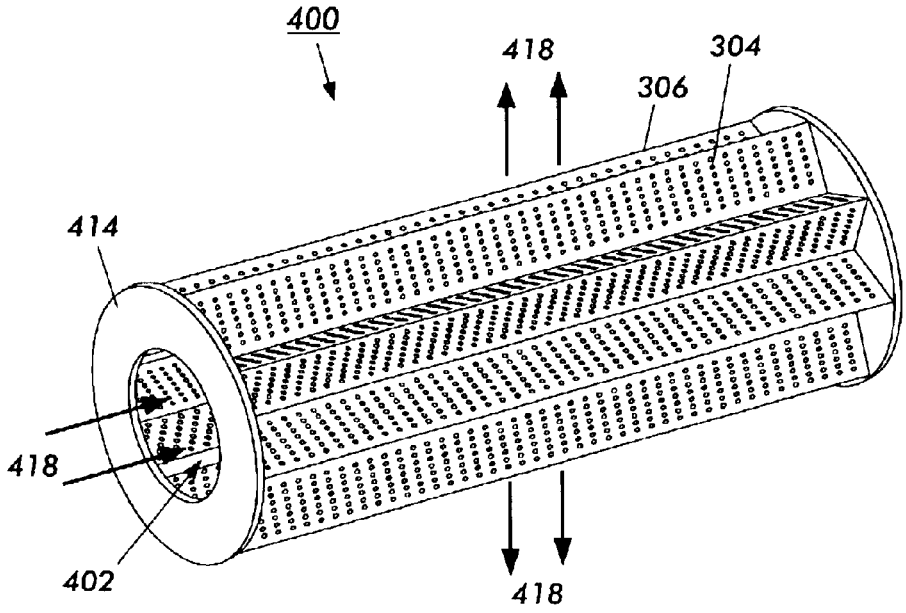
FIG. 11 is a perspective view of fluid flow into the closed loop pleated filter of FIG. 10.

As seen in FIG. 11, fluid 418 can flow in through the open end 414 or inlet port of the closed loop pleated filter 400 into the interior chamber 402 through the pores 304 in the inner surface 308 of the pleats 328 and out through the pores on the outer surface 306 of the pleats 328 outside the closed loop pleated filter. Any particles in the fluid larger than the filter pores 304 will be trapped inside the interior chamber 402 of the closed loop pleated filter with clean, particle-free fluid flowing downstream from the closed loop pleated filter.

Figure 12:
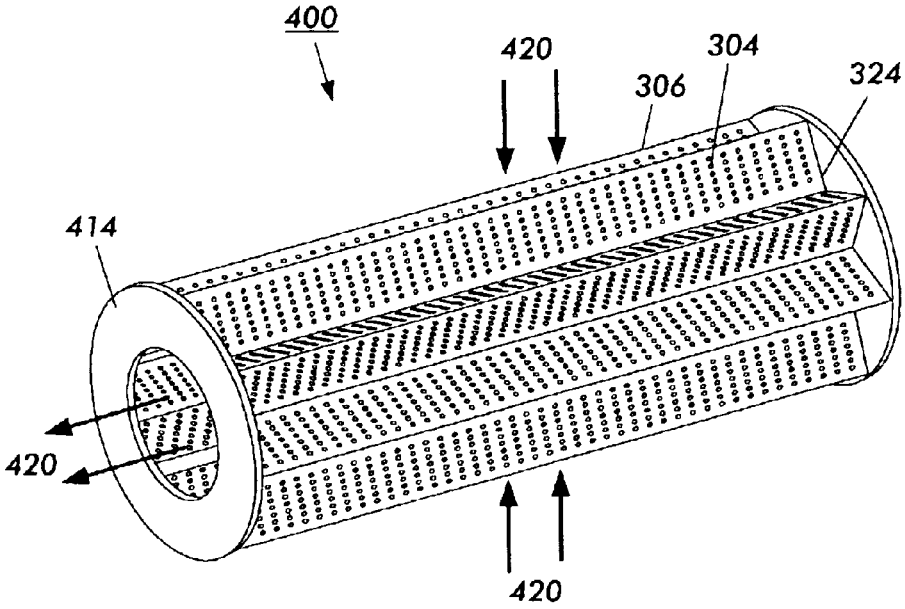
FIG. 12 is a perspective view of fluid flow out of the closed loop pleated filter of FIG. 10.

Alternately as shown in FIG. 12, fluid 420 can flow around the outside of the closed loop pleated filter 400 through the pores 304 in the outer surface 306 and out through the pores on the inner surface 308 into the interior chamber 402 and out through the open end 414 or outlet port of the closed loop pleated filter. Any particles in the fluid larger than the filter pores will be trapped outside the closed loop pleated filter in the grooves 324 with clean, particle-free fluid flowing downstream from the closed loop pleated filter.

The pleated filters of the present invention provide a larger surface area for filter pores than a planar filter. The pleated filters of the present invention can be positioned anywhere in the fluid path of the thermal ink jet printhead from ink supply tank to nozzle. The pleated filters of the present invention with their inlet ports or outlet ports can be sealed within the ink jet printhead channels and ink inlets in the fluid path so that ink is forced to flow through the filters.

Although the examples shown in the figures correspond to die module types in which the channels and ink inlets are formed by orientation dependent etching, other fabrication methods for the fluidic pathways are compatible with the laser ablated filter or filtering device described herein. And, although the exemplary laser ablation is accomplished through a mask, alternate light transmitting systems may be used such as, for example, diffraction optics displays or a microlens elements. It should be understood that the efficient filtering device of the present invention can be applied to thermal as well as piezoelectric or other electromechanical ink jet transducers and roof shooter geometries as well as side shooter geometries.

While the invention has been described in conjunction with specific embodiments, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

What is claimed is:

1. A fluid filtering device comprising:

a plate that has a rectangular shape and an internal reservoir;

a pleated member having a first side and a second side and formed on the plate and over an opening to the internal reservoir, said pleated member comprising a laser ablated film material; and a series of fluid flow holes formed through said pleated member from said first side to said second side.

2. The fluid filtering device of claim 1 wherein said laser ablated film material comprises a polymer film.

3. The fluid filtering device of claim 1 wherein said polymer film is chemically compatible with a fluid used in the fluid filtering device, and a temperature and pressure of the fluid.

4. The fluid filtering device of claim 1 wherein said pleated member is an open loop pleated member.

5. An ink jet print head assembly comprising:

ink supplying manifold;

a print head having ink ejecting nozzles;

a fluid path for directing ink from said ink supplying manifold to said ink ejecting nozzles; and a filtering device having a rectangular shape and an internal reservoir, the filtering device mounted in said fluid path for filtering such ink, said filtering device including:

a pleated member having a first side and a second side and formed over an opening to the internal reservoir, said pleated member comprising a laser ablated film material; and a series of fluid flow holes formed through said pleated member from said first side to said second side.

6. The ink jet print head assembly of claim 5 wherein said laser ablated film material comprises a polymer film.

7. The ink jet print head assembly of claim 5 wherein said polymer film is chemically compatible with a fluid used in the fluid filtering device, and a temperature and pressure of the fluid.

8. The ink jet print head assembly of claim 5 wherein said pleated member is an open loop pleated member.

9. A method of forming a filter element on a rectangular plate that has an internal reservoir to filter ink in an ink jet print head comprising the steps of:

positioning a thin polymer film in the output radiation path of an ablation laser;

positioning a mask between the laser and the film, the mask having a hole pattern sized to create the desired hole size of the filter element;

controlling the laser output so that the laser output is directed into said cavities forming a plurality of holes through the base of each said cavity forming the filter element;

folding said thin polymer film to form pleats and bonding the filter element to the rectangular plate and over an opening to the internal reservoir.

10. The method of forming a filter element to filter ink in an ink jet print head of claim 9 wherein said thin film polymer layer is folded to form open loop pleats.

* * * * *